United States Patent [19]

Friedebach

[11] Patent Number: 4,804,178

[45] Date of Patent: Feb. 14, 1989

[54] CROSS-COUNTRY SKI EXERCISE DEVICE

[75] Inventor: Adolf H. Friedebach, Cleveland, Ohio

[73] Assignee: Fitness Quest, Inc., Canton, Ohio

[21] Appl. No.: 122,459

[22] Filed: Nov. 19, 1987

[51] Int. Cl.[4] ..... A63B 69/18; A63B 21/00

[52] U.S. Cl. ..... 272/97; 272/131; 272/132

[58] Field of Search ..... 272/97, 73, 131, 132, 272/134, 96, 70, 93, 69, 72, 133; 128/25 R; 434/253

[56] References Cited

U.S. PATENT DOCUMENTS

| | | | |
|---|---|---|---|
| 1,982,843 | 12/1934 | Traver | 272/70 |
| 3,586,322 | 6/1971 | Kverneland | 272/72 |
| 3,601,395 | 8/1971 | Morgan | 272/73 |
| 3,941,377 | 3/1976 | Beitostolen | 272/57 |
| 4,023,795 | 5/1977 | Pauls | 272/97 |
| 4,343,466 | 8/1982 | Evans | 272/133 |
| 4,385,760 | 5/1983 | Mattox et al. | 272/131 |
| 4,402,506 | 9/1983 | Jones | 272/132 |
| 4,434,981 | 3/1984 | Norton | 272/97 |
| 4,529,194 | 7/1985 | Haaheim | 272/69 |
| 4,606,538 | 8/1986 | Wang | 272/134 |
| 4,618,139 | 10/1986 | Haaheim | 272/97 |
| 4,645,201 | 2/1987 | Evans | 272/97 |
| 4,653,749 | 3/1987 | Rorabaugh | 272/97 |
| 4,659,077 | 4/1987 | Stopkay | 272/97 |

*Primary Examiner*—Richard J. Apley

*Assistant Examiner*—S. R. Crow

*Attorney, Agent, or Firm*—Michael Sand Co.

[57] ABSTRACT

An exercise device for simulating cross-country skiing in which the user stands on a pair of footplates movably mounted on longitudinally extending rails of a base frame. U-shaped channels formed in the rails receive rollers mounted on the footplates to maintain engagement of said footplates with the rails. A belt is connected to the footplates and slideably extends about a plurality of rods mounted on the front and rear ends of the base frame, to reciprocate the footplates in unison in opposite directions along the rails. A tensioning bolt is mounted on one of the footplates and is connected to the belt for adjusting the resistance to the movement of said belt and footplates. A pair of levers which simulate ski poles are pivotally mounted on the front end of the frame. An adjustable resistance mechanism comprising a pair of plate members extends transversely across the front end of the frame and clampingly engages an extended end of each of the levers. A plurality of friction pads are positioned intermediate the plate members and the levers to provide frictional resistance to the pivotal movement of said levers. A centrally located adjustment bolt equally adjusts the gross resistance applied to the levers and arm movements of the user when reciprocating the levers, and a pair of outer adjustment bolts each selectively adjust the resistance applied to a respective one of the levers.

12 Claims, 2 Drawing Sheets

CROSS-COUNTRY SKI EXERCISE DEVICE

TECHNICAL FIELD

The invention relates to an exercise device and in particular to a device for simulating cross-country skiing. More particularly, the invention relates to an exercise device in which the forces and movement exerted on and carried out by a person using the device closely simulate those occurring in cross-country skiing to provide exercise and body development for the major muscle groups of the body.

BACKGROUND ART

Physical fitness and various forms of exercise ave increased considerably in popularity in recent years, as has the use of various devices permitting exercise in a confined area such as in a seperate room of a dwelling or in a gymnasium. Various forms of outdoor exercise also have increased in popularity, and in particular cross-country skiing. Cross-country skiing has been determined to be one of the most effective forms of exercise, both as a cardiovascular fitness exercise and for simultaneously exercising nearly every major muscle group in the body, without subjecting the body to the constant jarring and possibility of injury which sometimes results from other types of exercise. However, due to the limited time periods during which cross-country skiing can be carried out, that is, when there is adequate snow on the ground, individuals wish to be in shape for skiing as soon as there is adequate snow. Also, other individuals wish to derive the physical benefits from an exercise which closely simulates cross-country skiing without actually performing the skiing in the outdoor environment.

Various devices have been developed for indoor exercise which provide both the cardiovascular and muscular development as provided by cross-country skiing, and which simulate cross-country skiing for those who wish to develop the muscle control and stamina for performing the same during the off-season or for obtaining the physical benefits attendant thereto. Examples of such devices are shown in U.S Pat. Nos. 1,982,843; 3,941,377; 4,023,795; 4,402,506; 4,434,981; 4,529,194; and 4,659,077.

Other types of indoor exercise devices have been developed which simulate downhill-type skiing such as shown in U.S. Pat. Nos. 2,274,081; 3,408,067; 3,455,550; 3,475,021; 3,711,089; 3,729,207; 3,791,645; 3,807,727; 4,092,787; 4,252,312; 4,376,532; and 4,595,195. Still other types of exercise devices such as shown in U.S. Pat. Nos. 1,766,089; 3,332,683; 3,554,541; and 3,711,090 provide a treadmill effect which is beneficial for the leg muscles and cardiovascular fitness, but not the arms and upper body.

Although exercise devices of the type shown in the above-mentioned patents simulating cross-country skiing perform satisfactorily, they require a structure which is relatively expensive, especially when the exerciser is being developed for the home market in contrast to the even more expensive exerciser manufactured for use by commercial establishments such as gymnasiums, health spas, etc.

The closest known prior art to my invention is disclosed in U.S. Pat. No. 4,618,139. However, there are two primary differences between my exerciser and exercise machines of the type as shown in this patent. First, rollers of the present invention which provide movement for the footplates of the ski exerciser are trapped within U-shaped channels formed in elongated rails thereby preventing disengagement of the footplates from the rails whereas in prior devices the wheeled footplates merely roll along the top of the tracks in a manner similar to the wheels of a railcar. A second important difference is the manner in which resistance is applied to the movement of the levers or handles and the footplates, respectively. The ski exerciser of the present invention utilizes a single adjustable resistance mechanism which allows for both combined or independent adjustment of the arm activited levers, while many of the prior art exercise machines use a seperate adjustable clutch assembly for each handle.

Furthermore, the ski exerciser of the present invention utilizes a belt which is connected to each of the footplates and which slidably engages a pair of rods at the front and rear ends of the base frame to provide resistance to the movement of the footplates. The exercise machine of U.S. Pat. No. 4,618,139 uses a complex cable-pulley-clutch assembly to provide resistance to the movement of the footplates. Therefore, there are considerable differences between the ski exerciser of the present invention and the exercise machine disclosed in this patent and in other known prior art devices.

Therefore, the need has existed for an improved exercise device and in particular a device which simulates cross-country skiing, which can be produced economically yet which provides a sturdy, durable and smooth-operating device which achieves the desired physical results as those achieved by cross-country skiing, and which is usable within a protected environment.

DISCLOSURE OF THE INVENTION

Objectives of the invention include providing an improved exercise device which is of a compact and relatively inexpensive construction enabling it to be purchased by individuals for home use, and which provides for the development of nearly every major muscle group of the body as well as providing cardiovascular benefits by closely simulating the body movements required during cross-country skiing and the resulting exercise achieved thereby.

Another objective of the invention is to provide such an improved exercise device in which the user stands on a pair of footplates which are mounted for movement along elongated rails of a base frame; in which the footplates are connected by a belt so the plates move in unison in opposite directions; in which the tension in the belt is adjustable to vary the resistance to the movement of the footplates; and in which the movement of the footplates provides the same motion and resistance forces exerted on the lower body of the user as those which a skier experiences during cross-country skiing.

A further objective of the invention is to provide such an improved exercise device in which the footplates are movably mounted on the base frame by rollers which are captured in U-shaped channels formed in the rails thereby maintaining the footplates in their mounted position; in which the footplate connecting belt slideably engages rods mounted on the front and rear ends of the base frame to maintain tension in the belt and to maintain the belt in aligned position along the rails; in which the center of the stride length of the user is adjustable relative to the arm-actuated levers by adjusting the position of the footplates on the belt; in which the top surface of each of the footplates is angled to prevent the feet of the user from slipping off the footplates when the device is being used; and in which a single tensioning bolt enables the frictional resistance on the belt to be adjusted to provide variable resistance to the movement of the footplates by the lower body of the user.

Still another objective of the invention is to provide such an improved exercise device in which a pair of levers are movably mounted on the front end of the base frame to provide controlled resistance to the arm movements of the user simulating the effect of the forces exerted by a skier on ski poles; in which an adjustable resistance mechanism regulates the amount of force required to be exerted by the user to satisfactorily operate the levers; in which the movement of the simulated ski poles is completely independent of the amount of resistance applied to the lower body movements; and in which the amount of resistance force applied to the levers can be adjusted independently for each lever.

A still further objective is to provide such an improved exercise device in which a main adjustment bolt regulates the gross resistance to the movement of the levers and a pair of secondary adjustment bolts provide independent adjustment to each of the levers if it is desired by the user to apply a different resistance to each arm.

Another objective of the invention is to provide such an improved device which can be collapsed for storage and in which the height of the unit in the collapsed or folded position enables the unit to be slid under a bed, dresser, etc. for easy storage; and in which the length of the levers is adjustable to accommodate the needs of different users.

These objectives and advantages are obtained by the cross-country ski exercise device of the invention, the general nature of which may be stated as including: a base frame having front and rear ends and at least three spaced, parallel elongated rails extending longitudinally between said ends; a pair of footplates each movably mounted on a certain pair of the rails for reciprocating movement along said rail pairs; belt means extending along the rails and connected to each of the footplates for moving the footplates in unison in opposite directions along the rails; means for providing resistance to the movement of the belt means and footplates; a pair of levers pivotally mounted on the base frame adjacent the front end thereof, each of the levers having an extended end extending generally along the front end of said base frame; and plate means mounted on and extending generally across the front end of the base frame and clampingly engaged with the extended ends of the levers for providing frictional resistance to the pivotal movement of said levers.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
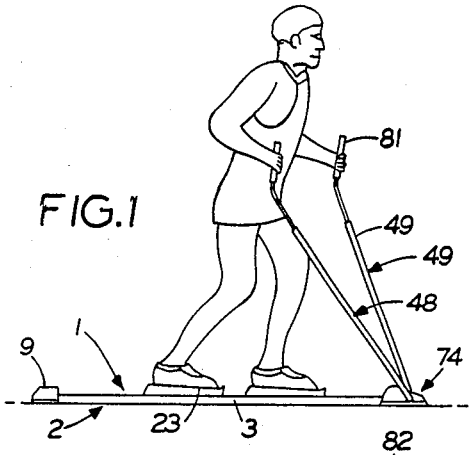
FIG. 1 is a diagrammatic view showing an individual using the improved exercise device.
Figure 4:
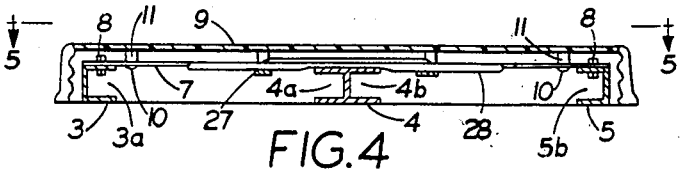
FIG. 4 is an enlarged fragmentary sectional view taken on line 4—4, FIG. 2.
Figure 5:
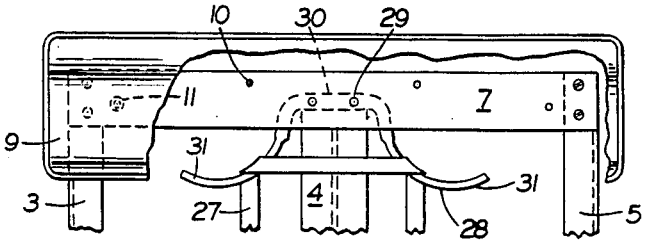
FIG. 5 is a fragmentary top plan view with portions broken away, looking in the direction of arrows 5—5, FIG. 4.
Figure 2:
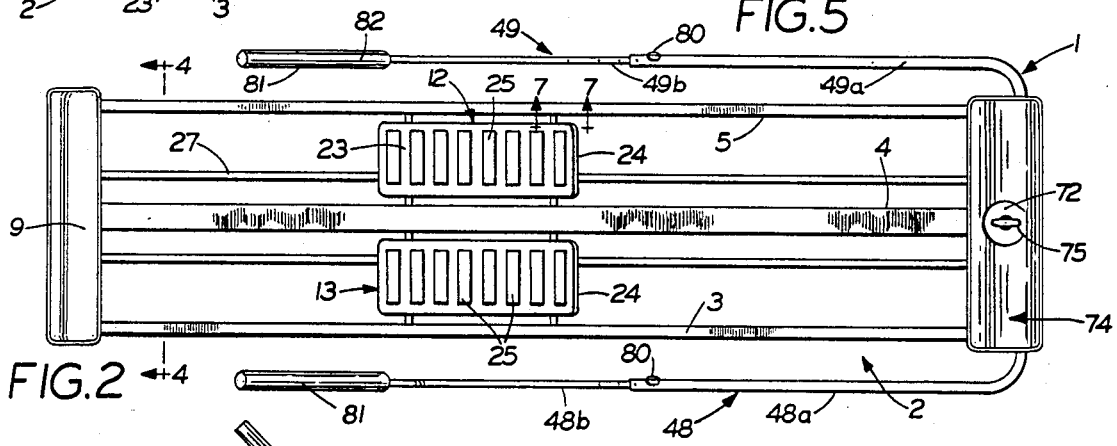
FIG. 2 is an enlarged top plan view of the exercise device of FIG. 1.
Figure 3:
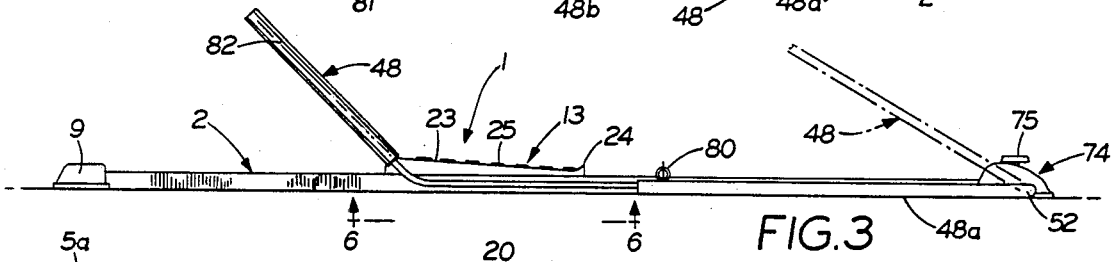
FIG. 3 is a side elevational view of the exercise device shown in FIG. 2 with a hand-operated lever shown in fragmentary in dot-dash lines in a forward position.

The improved exercise device is indicated generally at 1, and is shown particularly in FIGS. 1, 2 and 3. Device 1 includes a main base frame or platform indiciated generally at 2, formed by three longitudinally extending, spaced parallel rails, indicated at 3, 4 and 5, which are joined together at a rear end by a frame member 7 (FIGS. 4 and 5). Frame member 7 is attached to the rails by a plurality of fasteners 8. A protective and decorative plastic cover 9 is mounted on member 7 to conceal the rear end portions of the rails and frame member, by a plurality of fasteners 10 which extend into spacers 11, preferably formed integrally with cover 9.

Outer rails 3 and 5 are formed with U-shaped channels 3*a* and 5*a*, respectively, with intermediate rail 4 being an I-shaped member being formed with a pair of U-shaped channels 4*a* and 4*b* as shown particularly in FIG. 4. Frame members 3–5, and in particular the channels formed thereby, form a pair of parallel elongated tracks on which a pair of footplates, indicated generally at 12 and 13, are movably mounted.

Figure 8:
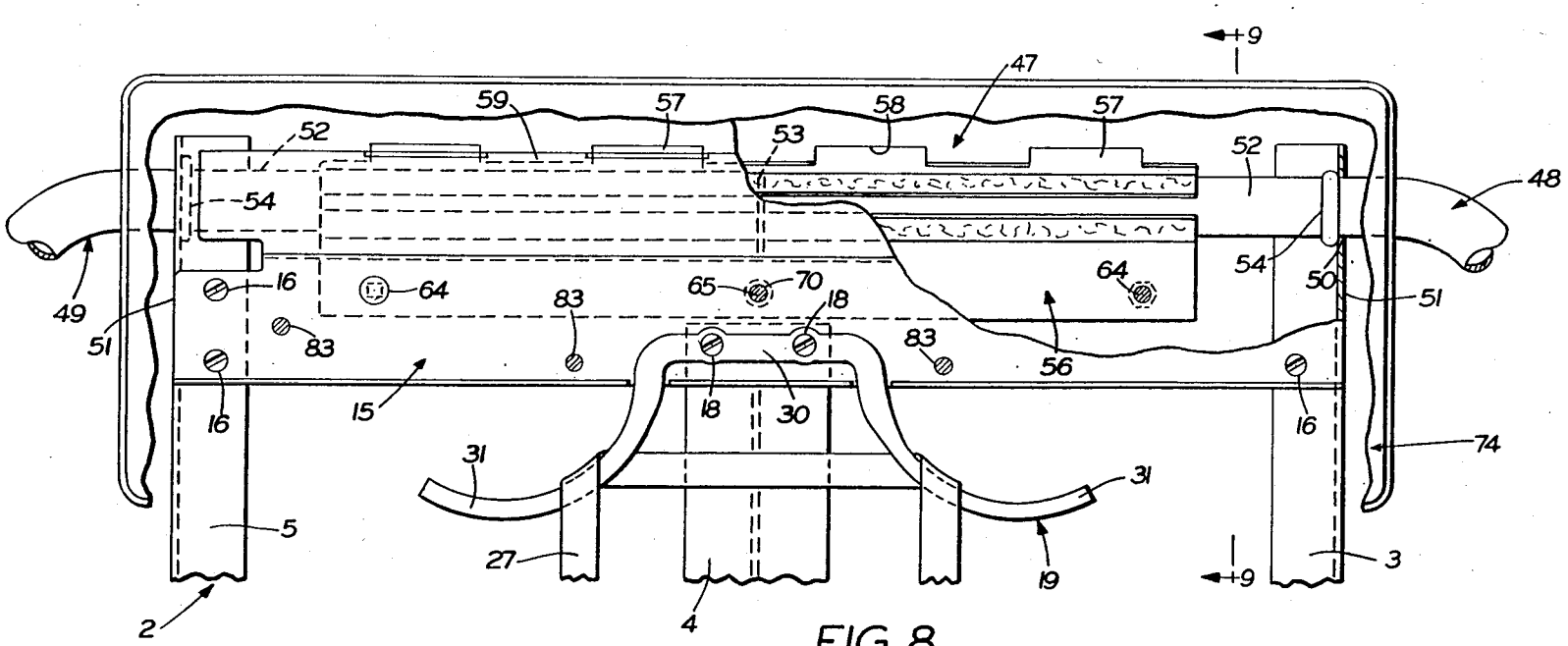
FIG. 8 is an enlarged fragmentary top plan view with portions broken away and in section, of the front portion of the improved exercise device.
Figure 9:
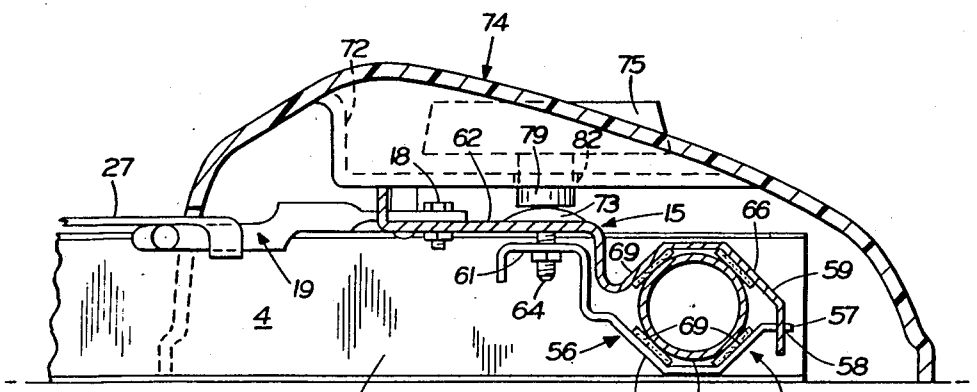
FIG. 9 is an enlarged fragmentary sectional view taken on line 9—9, FIG. 8.

The front ends of the rails are connected together in forming base frame 2 by a main top plate, indicated generally at 15 (FIGS. 8 and 9). Plate 15 is shown in fragmentary view in FIG. 8 and is secured to outer rails 3 and 5 by fasteners 16. Top plate 15 also is secured to intermediate rail 4 by a pair of fasteners 18 which also mount a belt engaging rod, indicated generally at 19, thereto.

Footplates 12 and 13 are mounted for rolling movement within the U-shaped channels of the rails, each by two pairs of wheels 20, which are rotatably mounted on the outer ends of fixed axles 21. The location of wheels 20 in the U-shaped channels prevent sideways, and upward and downward movement of the footplates on the rails by trapping the wheels within the channels. This prevents dislocation of the footplates from the rails as occurs in prior exercise devices in which supporting rollers merely roll along the top of a frame member or rail. Wheels 20 preferably are formed of high strength plastic or other material providing a silent, low friction, rolling movement of the footplates along the metal frame members.

The top surface 23 of the footplates is angled downwardly forwardly as shown in FIG. 1 and terminates in a raised front edge 24 which prevents the user's foot from slipping off of the footplate when the device is being used. Also a plurality of raised pads 25 project upwardly from top surface 23 and may have a nonskid surface thereon to further resist movement of the user's foot on the footplate once placed in position thereon. This enables the force exerted by the user to be transmitted directly to the plates and through the rollers to the supporting rails for longitudinal rolling movement therealong.

Figure 6:
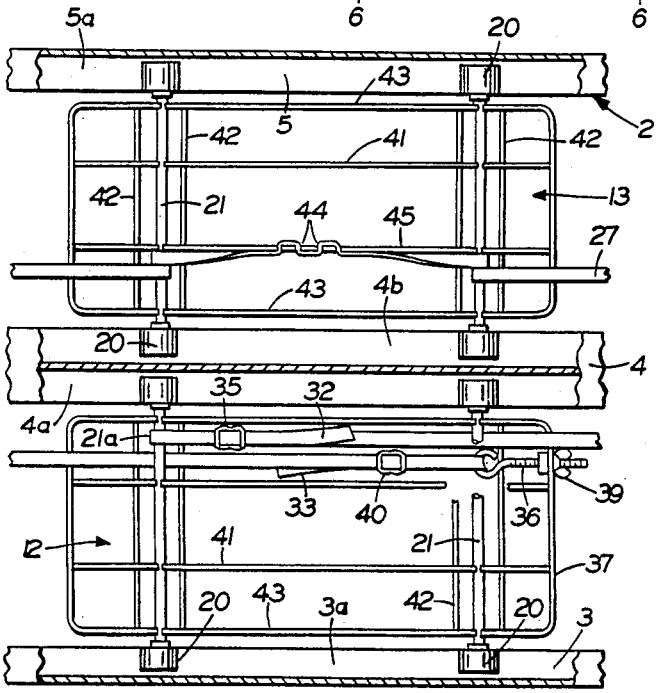
FIG. 6 is an enlarged fragmentary elevational view with portions broken away and in section, looking in the direction of arrows 6—6, FIG. 3.

Referring to FIGS. 2, 5, 6 and 8, a single, flexible belt 27, preferably formed of plastic material, is trained about front rod 19 and about a similarly configured rod 28 mounted on rear frame member 7 by a plurality of fasteners 29. Rods 19 and 28 are each formed with a main base 30 and a pair of outwardly curved ends 31. Belt 27 extends longitudinally along the pair of tracks as shown in FIG. 2, and is looped about curved rod ends 31 as shown particularly in FIGS. 5 and 8. The belt terminates in a pair of ends 32 and 33 as shown in FIG. 6. Belt end 32 loops about one of the footplate axles indicated at 21*a*, and is secured thereto by an adjustment buckle 35. Belt end 33 extends through the eyelet end of an eyebolt 36, the shaft of which extends through an opening formed in an end wall 37 of footplate 12, and is adjustably mounted therein by a wing nut 39. Another buckle 40 secures belt end 33 on eyebolt 36 in a similar manner as adjustment buckle 35 of belt end 32.

Wing nut 39 enables eyebolt 36 to be adjusted easily with respect to footplate end wall 37, which enables the tension applied to belt 27 to be adjusted thereby varying the amount of sliding resistance exerted between the belt and curved rod ends 31. With this particular arrangement, the footplates move in unison in opposite directions along the rails to simulate the preferred motion of a cross-country skier. Adjustment of eyebolt 36 regulates the tension on belt 27. This varies the resistance to the movement of the footplates by regulating the sliding frictional resistance between belt 27 and rod ends 31 to provide the user with a desired amount of tension on the footplates for exercising the lower body. Thus, greater the tension on belt 27, greater will be the resistance applied to the movement of the belt over the rod ends and correspondingly more effort must be exerted by the user of device 1.

Figure 7:
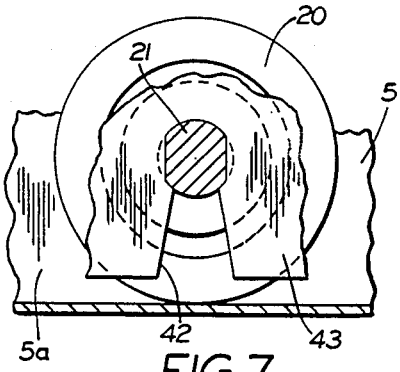
FIG. 7 is an greatly enlarged fragmentary sectional view taken on line 7—7, FIG. 2.

Footplates 12 and 13 preferably are provided with a plurality of reinforcing ribs 41 and 42 formed on the bottom thereof, as shown in FIG. 6, which provide rigidity to the footplate. Axles 21 are attached easily and inexpensively to the footplates by snap-fitting them into a tapered groove 42 formed in sidewalls 43 of each footplate as shown particularly in FIG. 7. The axles preferably are nonrotatable with respect to the footplates with the rotation being achieved by the rotatable mounting of wheels 20 on the outer ends of the axles.

In accordance with another feature of the invention, as shown particularly in FIG. 6, belt 27 is firmly attached to footplate 13 by looping the belt through a plurality of slots 44 formed in a bottom reinforcing wall or rib 45 and by looping the belt around the two adjacent axles 21. This triple bend and looped configuration, as shown in FIG. 6, prevents movement of the belt with respect to footplate 13 and eliminates any additional fasteners or attachment components from being utilized to secure the belt to the footplates as in prior exercise devices using movably mounted footplates or feet support platforms.

Figure 10:
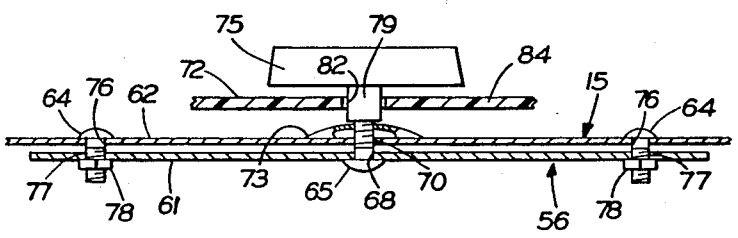
FIG. 10 is a fragmentary diagrammatic sectional view showing the three points of adjustment for varying the tension on the arm actuated levers.

In accordance with another of the features of the invention, an improved tensioning mechanism indicated generally at 47 (FIGS. 8–10) is mounted on the front end of base frame 2 and is operatively connected to a pair of arm actuated levers indicated generally at 48 and 49, which are pivotally mounted for back and forth movement by the user to simulate the movement of ski poles. Levers 48 and 49 are pivotally mounted by ends 52 thereof extending through openings 50 formed in sidewalls 51 of outer rails 3 and 5. Extended ends 52 extend transversely across the front end of base frame 2 (FIG. 8) and terminate in a spaced relationship, separated by a gap indicated at 53. Lever ends 52 are prevented from outward movement from their pivotal mounting on the outer rails by an annular collar or boss 54 formed thereon, which abuts the respective rail sidewall 51. Inward movement of the lever ends is prevented by the mutual engagement thereof upon closing separating gap 53.

A secondary clamping plate, indicated generally at 56, is mounted beneath main top plate 15 by a plurality of bent end tabs 57 which extend through complementary-shaped slots 58 formed in a downwardly extending front end 59 of top plate 15 (FIGS. 8 and 9). The rear portion of secondary plate 56 terminates in a U-shaped channel which includes a web wall 61. Wall 61 is located beneath and extends along a horizontal wall section 62 of main top plate 15 and is connected thereto by a pair of end carriage bolts 64 and a center carriage bolt 65, the purposes of which are described in greater detail below. Top plate 15 and bottom plate 56 are formed with generally semicircular-shaped three flat sided end sections 66 and 67, respectively, which are placed in alignment as shown in FIG. 9 to form a generally hexagonal-shaped elongated opening between the two plates in which extended lever ends 52 are located. Four strips or pads 69 of friction material are laid along extended lever ends 52 in diametrically opposite positions on opposed flat surfaces of sections 66 and 67 of plates 15 and 56. Manual manipulation of bolts 64 and 65 provide controlled adjustment of the resistance applied to the pivotal movement of levers 48 and 49.

In accordance with another of the features of the invention, tensioning mechanism 47, and in particular top plate 15 and bottom clamping plate 56, provide a variety of adjustments to the frictional resistance exerted on the levers by friction pads 69. A main adjustment for simultaneously adjusting the tension or frictional resistance exerted on both lever ends, is provided by center bolt 65. Carriage bolt 65 extends through an opening 70 (FIGS. 8–10) formed in horizontal wall section 62 of top plate 15 and through an adjacent squared hole 68 formed in web wall 61 of clamping plate 56 and through the central hole of a bellville washer 73 and into engagement with a threaded stub shaft 79 of an adjustment knob 75. Knob shaft 79 extends through a hole 82 formed in a wall 84 of a circular recess 72 of a decorative protective plastic enclosure, indicated generally at 74 and into engagement with washer 73. Cover 74 is mounted on and encloses the front end of base frame 2.

Rotation of knob 75 will draw horizontal web wall 61 of clamping plate 56 upwardly toward wall section 62 of plate 15, which will clamp the friction pads equally against both extended lever ends 52. This provides the user of the device a readily available and easily manipulated mechanism for adjusting the resistance applied to the arm-actuated levers which simulate the ski poles in cross-country skiing. The user, by rotating knob 75, controls the amount of resistance applied to the levers to suit his or her individual wishes.

Another feature is that end bolts 64 provide individual adjustments for the resistance which is applied to the individual lever ends by the friction pads. Bolts 64 are carriage bolts mounted in squared openings 76 formed in wall section 62 of top plate 15, with the threaded shafts thereof extending through opening 77 formed in web wall 61 of clamping plate 56. Rotation of nut 78 which is mounted on the bolt shafts provides individual resistance adjustment to the desired lever end without materially affecting the previously set resistance on the opposite lever end. Therefore, a user can independently adjust the frictional resistance exerted on each lever end, and can adjust the resistance applied equally to both of the lever ends by manipulation of the single center bolt 65 upon rotation of knob 75.

Levers 48 and 49 preferably are formed of metal tubing and include lower sections **48*a* and 49*a*, respectively, which curve integrally into and form the extended lever ends 52. Telescopically adjustable upper sections 48*b* and 49*b* are slideably mounted within the respective lower lever sections and are retained in an adjusted position by ring pins 80. Pins 80 extend through aligned holes formed in the telescopically engaged tube sections. The upper end of lever sections 48*b* and 49*b* terminate in handles 81, which are covered with soft resilient handgrips 82, which are grasped by the user. As shown particularly in FIG. 3, handle ends 81 are bent upwardly at an angle of approximately 45 degrees with respect to the longitudinal axis of the lever. This enables the handle portion to be maintained in a relatively vertical position, as shown in FIG. 1**, regardless of the length of the lever caused by the telescopic sliding engagement of the upper lever section in the lower lever section. Thus, the levers provide the same gripping and movement action whether used by short or tall individuals.

Protective enclosure cover 74 provides an attractive cover to the front end of the exercise device and encloses the extended ends of the levers and tensioning mechanism therefor. Cover 74 is mounted on the frame by a plurality of fasteners 83 located along the length thereof as shown in cross-section in FIG. 8.

In accordance with the invention, the low profile provided by the improved exercise device as shown in FIG. 3 enables the device to be slid easily beneath a dresser, bed, etc. for easy storage. Rotating handle ends 81 from the position shown in FIG. 3 approximately 90 degrees to a flat position (not shown) by removing ring pins 80, provides a device which when in collapsed position, has a storage height of less than five inches. Also, the formation of the components of light-weight metal tubing and alumninum channel members, and the forming of the footplates and protective end covers of light-weight high strength plastic material, further provides a unit which is extremely lightweight for ease of storage and/or movement in a dwelling for use by an individual. Such a construction also provides a unit which is extremely sturdy and durable in use and relatively maintenance free.

The operation of improved exercise device 1 is set forth below. A user stands on footplates 12 and 13 and grasps the ends of levers 48 and 49, as shown particulary in FIG. 1. The user then begins a reciprocal foot motion on the footplates and on the arm levers with the resistance being variable and independent for both the upper and lower body as described above. This enables the user to achieve the desired amount of pressure for both the upper and lower body muscle groups enabling them to be exercised at different resistance levels to accommodate individuals of varying upper and lower body strength and enabling the upper and lower muscle groups to be developed at different rates more closely matching the individual who is using the exercise device of the invention. Also as discussed above, the resistance on the individual levers can be adjusted independently of each other or in unison, depending upon the desires of the user. Also the position of the footplates to vary the stride thereof, may be regulated by moving the initial setting of the footplates by temporarily moving belt 27 from within slots 44 (FIG. 6) and adjusting the position of one of the footplates with respect to the other. This enables the stride length of the user to be adjusted by adjusting the position of only one footplate on the belt.

Accordingly, the improved exercise device of the invention provides a mechanism which is extremely strong and durable in use, which is formed of rigid, light-weight metal components, and which provides a device which closely simulates the action and forces exerted on the user that occur during actual cross country skiing in order to provide the cardiovascular benefit, as well as the exercising of nearly all of the major muscle groups at a pace and level of ability of the individual user by adjusting the independent tensioning mechanisms on the upper and lower body mechanisms. It provides a device in which the reciprocating forward and rearward motion of the footplates simulate the movement of the skis, and in which the movement of the levers simulate the movement of the ski poles. Furthermore, the footplates are trapped in the U-shaped channels of the track rails preventing unwanted or premature disengagement therefrom during operation of the device, eliminates heretofore complicated cable-pulley-clutch assemblies to provide resistance to the movement of the footplates, and provides an extremely simple, inexpensive, yet effective adjustment mechanisms for varying the resistance applied against the movement of the arms in a manner heretofore not believed achieved by prior art exercise devices. It has been discovered that the improved exercise device of the invention is much less demanding of body coordination than prior art cross-country ski exercise devices.

Accordingly, the improved exercise device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved exercise device is constructed and used, the characteristics of the construction, and the advantageous, new and useful results obtained; the new and useful structures, devices, elements, arrangements, parts, and combinations, are set forth in the appended claims.

What is claimed is:

1. An exercise device including:

(a) a base frame having front and rear ends and at least three spaced, parallel elongated rails extending longitudinally between said ends;

(b) a pair of footplates, each movably mounted on a certain pair of the rails for reciprocating movement along said rail pairs;

(c) belt means extending along the rails and connected to each of the footplates for moving the footplates in unison in opposite directions along the rails;

(d) means for providing resistance to the movement of the belt means and footplates;

(e) a pair of levers pivotally mounted on the base frame adjacent the front end thereof, each of the levers having an extended end extending toward each other generally along the front end of said base frame;

(f) a pair of plate members each mounted on and extending generally across the front end of the base frame, said extended ends of the levers extending generally between the plate members and between a plurality of friction pads positioned between the extended ends of the levers and said plate members, said extended ends of the levers being clampingly engaged between the plate members and said friction pads for providing frictional resistance to the pivotal movement of said levers; and (g) a central adjustment bolt and a pair of outer adjustment bolts, said bolts being selectively tightened for clamping the plate members and said friction pads against the extended ends of the levers to provide the frictional resistance to the pivotal movement of said levers, said central bolt equally adjusting the gross resistance to the pivotal movement of the levers, and said outer bolts each independently adjusting the resistance to the movement of a respective one of the levers.

2. The exercise device defined in claim 1 in which a plurality of rollers are mounted on each of the footplates; and in which at least one U-shaped channel is formed in each of the rails for receiving said rollers to maintain the footplates in mounted position on said rails.

3. The exercise device defined in claim 2 in which the base frame includes a pair of outer rails and an intermediate rail; in which each of the outer rails has a U-shaped channel formed therein and the intermediate rail has a pair of said U-shaped channels formed therein; and in which each of the footplates is movably mounted on a respective one of the outer rails and the intermediate rail.

4. The exercise device defined in claim 1 in which the belt means is a one-piece belt.

5. The exercise device defined in claim 1 in which the means for providing resistance to the movement of the belt and footplates is a plurality of rods mounted on the front and rear ends of the base frame which are slidably engaged by the belt to provide frictional resistance therebetween.

6. The exercise device defined in claim 5 in which a tensioning bolt is mounted on one of the footplates and is connected to the belt for adjusting the sliding resistance to the movement of the belt with respect to the rods.

7. The exercise device defined in claim 1 in which each of the levers comprises a lower section having the extended end formed thereon, and an upper section terminating in a handle; and in which the upper section telescopically engages the lower section for adjusting the length of the lever.

8. An exercise device including:

(a) a base frame having front and rear ends and at least three spaced, parallel elongated rails extending longitudinally between said ends;

(b) a pair of footplates, each movably mounted on a certain pair of the rails for reciprocating movement along said rail pairs;

(c) belt means extending along the rails and connected to each of the footplates for moving the footplates in unison in opposite directions along the rails;

(d) a pair of levers pivotally mounted on the base frame adjacent the front end thereof, each of the levers having an extended end extending toward each other generally along the front end of said base frame;

(e) plate means located adjacent the front end of the base frame and operatively engageable with the extended ends of the levers for providing frictional resistance to the pivotal movement of the levers; and (f) adjustment means for selectively clamping the plate means against the extended ends of the levers for equally adjusting the gross resistance to the pivotal movement of both of the levers and for independently adjusting the resistance to the movement of a respective one of the levers.

9. The exercise device defined in claim 8 including rod means for providing resistance to the movement of the belt means and footplates.

10. The exercise device defined in claim 9 in which the rod means is a plurality of rods mounted on the front and rear ends of the base frame which are slideably engaged by the belt means to provide frictional resistance therebetween.

11. The exercise device defined in claim 8 in which the adjustment means includes a plurality of bolts.

12. The exercise device defined in claim 11 in which the plurality of adjustment bolts comprise a central bolt for equally adjusting the gross resistance to the pivotal movement of the levers, and a pair of outer bolts which each independently adjust the resistance to the movement of a respective one of the levers.

* * * * *